United States Patent [19]

Steenmeijer et al.

[11] 3,999,156

[45] Dec. 21, 1976

[54] BISTABLE MAGNETIC SWITCH COMPRISING STRIP CONTACTS

[75] Inventors: Jan Paul Steenmeijer; Gerrit van Dijk, both of Hilversum, Netherlands

[73] Assignee: U.S. Philips Corporation, New York, N.Y.

[22] Filed: June 23, 1975

[21] Appl. No.: 589,339

[30] Foreign Application Priority Data

July 2, 1974 Netherlands ..... 7408907

[52] U.S. Cl. ..... 335/79; 335/83; 335/196

[51] Int. Cl.[2] ..... H01H 51/22

[58] Field of Search ..... 335/78, 79, 80, 81, 335/83, 84, 85, 196

[56] References Cited

UNITED STATES PATENTS 3,128,355 4/1964 Fuller ..... 335/196 X
3,294,944 12/1966 Angermaier et al. ..... 335/196 X
3,869,684 3/1975 Grobe ..... 335/79 X

*Primary Examiner*—George Harris
*Attorney, Agent, or Firm*—Frank R. Trifari; David R. Treacy

[57] ABSTRACT

A bistable switch comprising an electrically and magnetically conductive flexible contact member clamped at one end, the other freely movable end being alternately brought into contact, by a magnetic excitation flux, with one of two electrically and magnetically conductive counter-contacts. After termination of the excitation flux, the contact position is maintained by a permanent magnet. The contact member comprises a strip-shaped portion having a high magnetic resistance which is comparatively flexible and a strip-shaped portion having a low magnetic resistance which is comparatively rigid. The magnetic as well as mechanical properties of such a switch can thus be optimized.

8 Claims, 3 Drawing Figures

BISTABLE MAGNETIC SWITCH COMPRISING STRIP CONTACTS

Figure 1:
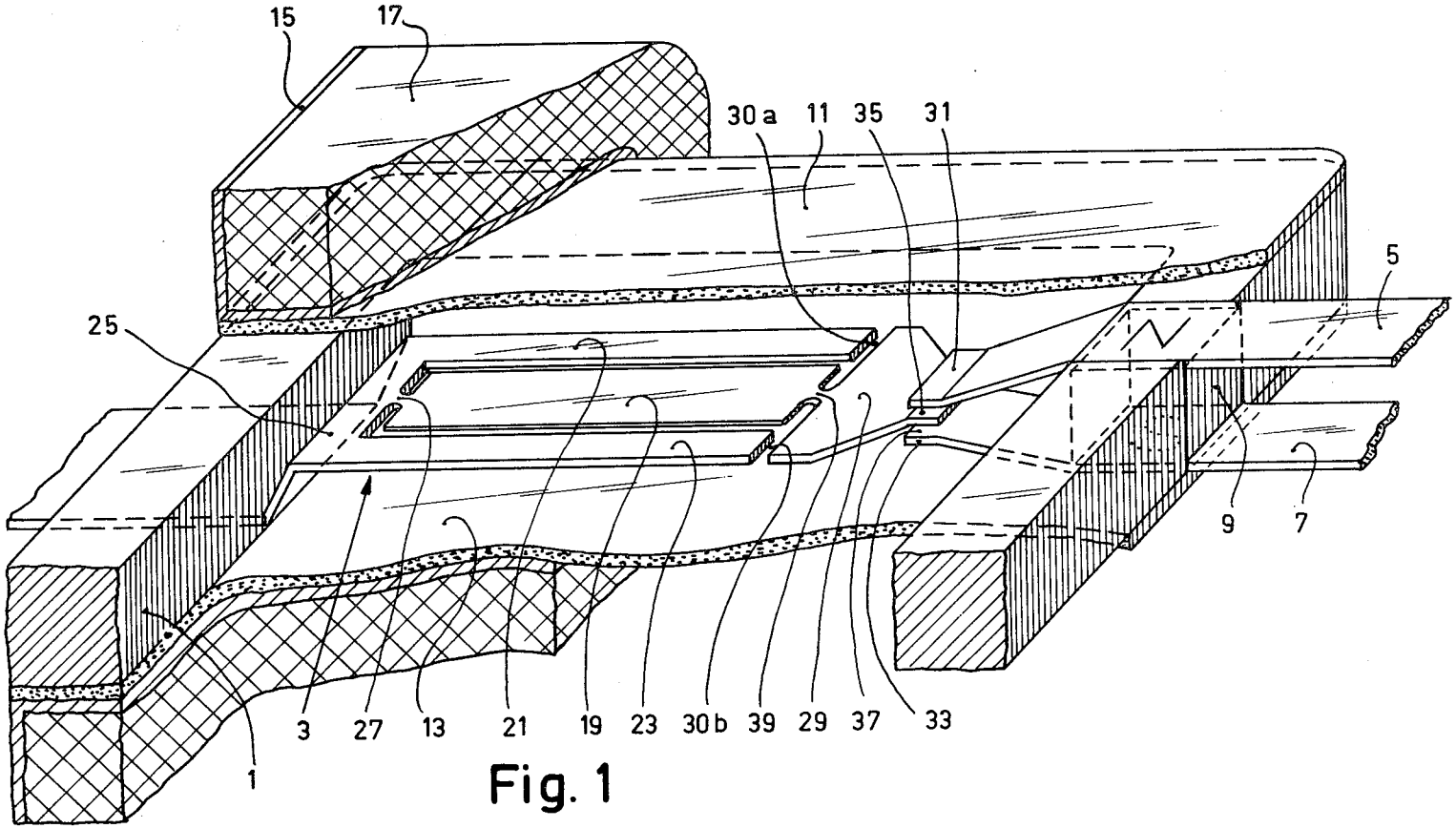

The invention relates to a bistable switch comprising a strip-shaped contact member of magnetically and electrically conductive material which is clamped near a first end, a second, freely movable end of the member being alternately in contact with one of two permanently arranged magnetically and electrically conductive counter-contacts because of an externally generated magnetic flux, the counter-contacts forming part of the magnetic flux path of a permanent hold magnet which also includes the free end of the contact member and the contact openings present between the free end and the counter-contacts.

In a known bistable switch of this kind, described in U.S. Pat. No. 2,245,391, the contact member consists of a unilaterally clamped, flexible metal strip which conducts the magnetic excitation flux as well as the current. The excitation flux is generated by means of a coil which envelops the contact member. In view of ever-progressing miniaturization, as small as possible a thickness of strip-shaped contact member is used for the above described bistable switches. Any reduction of this thickness enables a reduction of the required magnetic field strength, because on the one hand the mass of the contact member to be accelerated during the contact movement becomes smaller, while on the other hand the bending stiffness of the contact member is reduced. This offers the possibility of using smaller excitation coils. This greater flexibility, moreover, offers the advantage that the hold flux which originates from a permanent magnet and which serves to keep the contact member in one of the two stable positions after termination of the coil excitation may be smaller. As a result, smaller permanent magnets can be used. Also, thinner contact members in bistable switches ensure uniformity of the contact pressure in the two contact positions. A reduction of the thickness of the strip-shaped contact member in the known bistable switch, however, influences the mechanical as well as the magnetic behavior of the contact member. Optimizing the mechanical and magnetic properties of the contact member is always limited to a compromise between the two kinds of property, the compromise being mainly governed by factors such as magnetic saturation, bouncing, response time, contact pressure, material purity.

The invention has for its object to realize a bistable switch which allows independent optimizing of the mechanical and the magnetic properties of the switch and which, moreover, enables the use of large-scale manufacturing techniques.

To this end, a bistable switch according to the invention is characterized in that the contact member comprises a bending-resistant portion, having a comparatively low magnetic resistance, and a flexible portion having a comparatively high magnetic resistance.

A special switch according to the invention, having contacts which can be manufactured by etching and punching techniques, is moreover characterized in that the contact member consists of a flexible central strip, having a comparatively high magnetic resistance, and two comparatively rigid lateral strips, having a comparatively low magnetic resistance, which are situated in the same plane on both sides of the central strip, the central strip and the two lateral strips together constituting a fork-shaped contact member.

The invention will be described in detail hereinafter with reference to the drawing.

Figure 2:
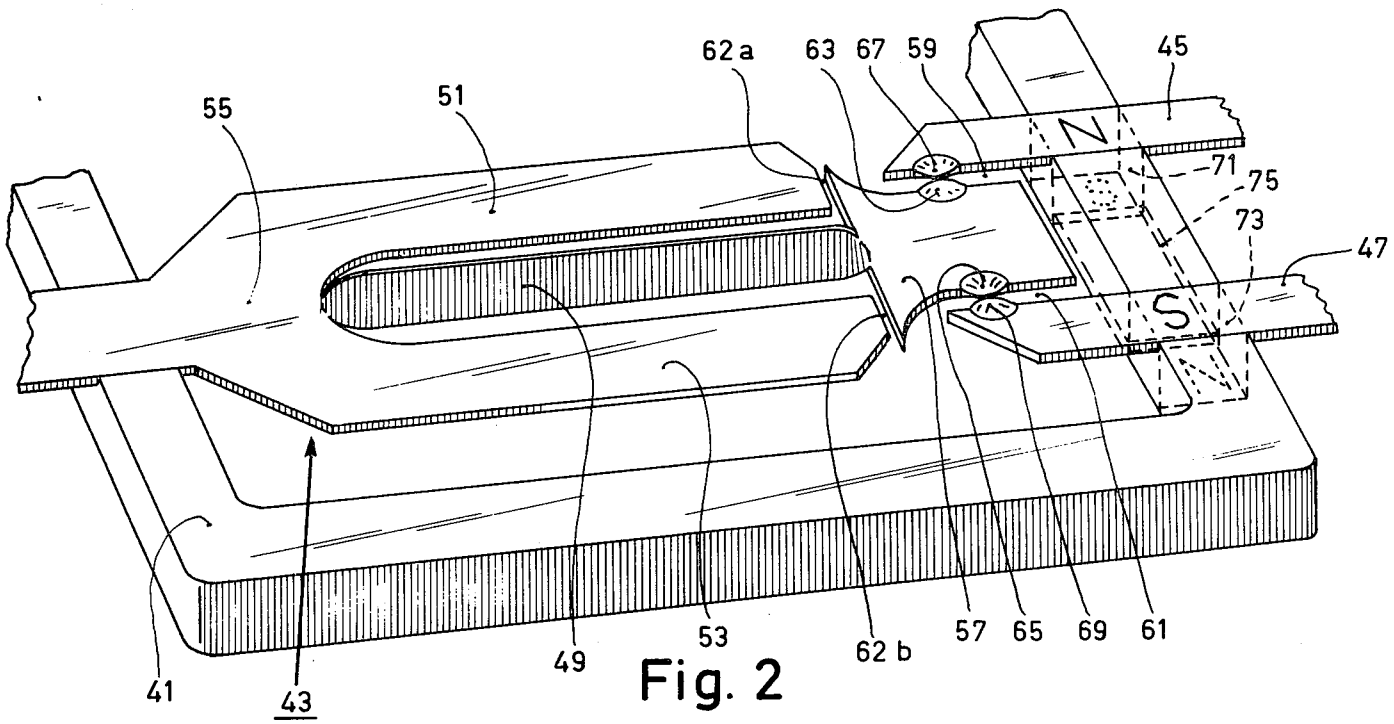
Figure 3:
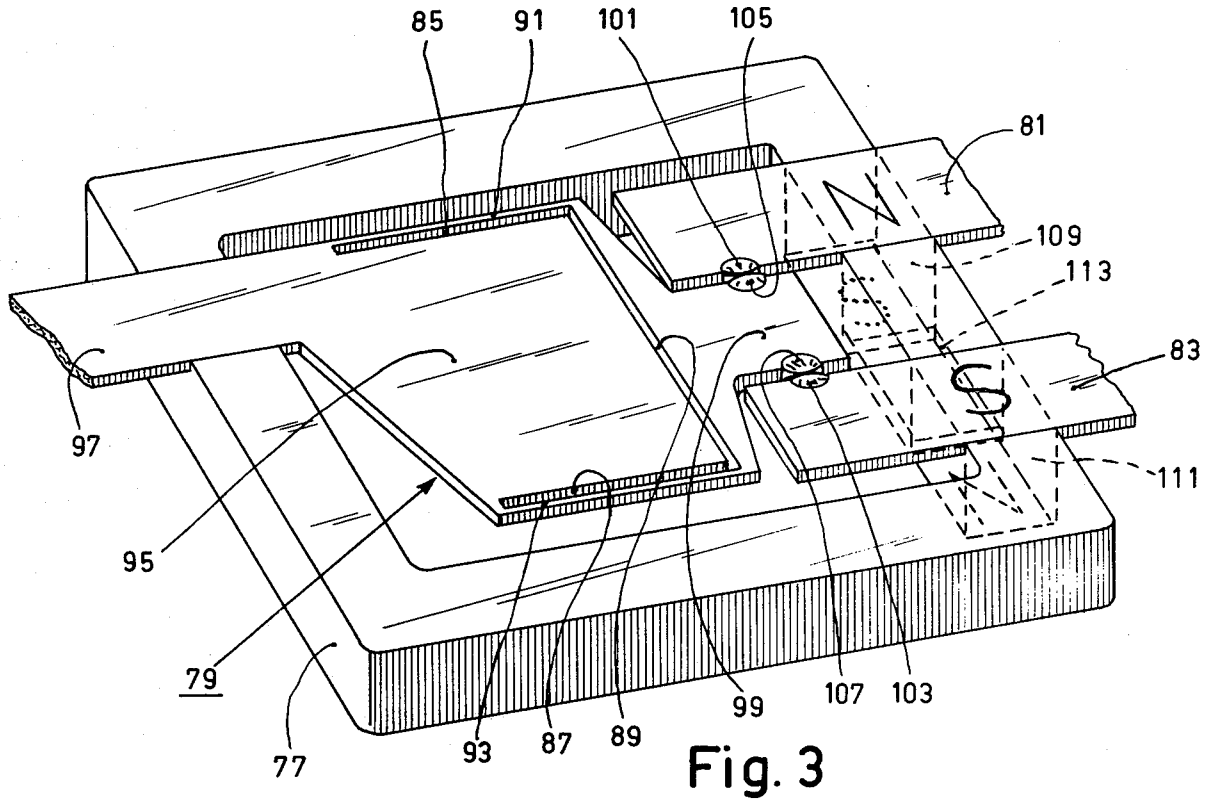

FIG. 1 is a perspective plan view of a preferred embodiment of a bistable switch according to the invention, FIG. 2 is a perspective plan view of a second embodiment of a bistable switch according to the invention, and FIG. 3 is a perspective plan view of a third embodiment of a bistable switch according to the invention.

The bistable switch illustrated in FIG. 1 comprises a rectangular frame or ring 1 of hard-magnetic material on which a contact member 3 and two counter-contacts 5 and 7 are provided. The contact member 3 and the counter-contacts 5 and 7 consist of strips of magnetically and electrically conductive material, such as, for example, an alloy containing 50% iron and 50% nickel. A permanent magnet 9 is formed in the frame of ring 1 by local magnetization, the said magnet being situated between the counter-contacts 5 and 7 which extend on both sides of the frame 1. The contact strips 3, 5 and 7 are arranged in recessed tracks which are ground into the frame 1. The contact strips 3, 5 and 7 are connected to the frame 1 by means of a suitable enamel. Because the contact strips are situated in recessed tracks of the frame 1, the space within the frame can be hermetically sealed by flat cover plates 11 and 13. The cover plates 11 and 13 are made of a type of glass — for example, leaded glass — which is sensitive to exposure to infra-red light, so that a fused connection can be obtained between the plates 11 and 13 and the frame and the contact strips 3, 5 and 7. The hermetically sealed assembly thus obtained is arranged in a sleeve 15 on which an excitation coil 17 is provided.

The contact member 3, made of strip material having a thickness of, for example, 0.3 mm, comprises three portions 19, 21, 23 which are situated in the same plane. Like the rest of the contact member 3, the portions 19, 21 and 23 themselves are mainly strip-shaped. The portions (strips) 19, 21 and 23 are interconnected by a common base portion 25 and constitute the mainly fork-shaped contact member 3 in conjunction with this base portion. The longitudinal axes of the strips 19, 21 and 23 are parallel to each other. The central strip 19 has a constriction 27 on its end which is situated near the base portion 25. Near its end which is remote from the base portion 25 and which extends beyond the free ends of the strips 21 and 23, the strip 19 is provided with a flap 29 which defines, in conjunction with the ends 31 and 33 of the counter-contacts 5 and 7, respectively, the contact openings 35 and 37. Between the flap 29 and the free ends of the strips 21 and 23 are air gaps **30*a* and 30*b* which are as small as possible. The strip 19 has a second constriction 39 at the area of the connection between the comparatively flexible central portion of the strip and the comparatively rigid flap 29. The constrictions 27 and 39 have been produced by planishing the central portion of the strip 19 to a thickness of approximately 0.1 mm. The strips 21 and 23 have a thickness of 0.3 mm. Even though the strip 19 is preferably planished so as to achieve suitable flexibility, this is not necessary and the constrictions can be made in a manner other than by planishing, for example, by etching or punching. This is because the constrictions 27 and 39 per se already impart a given flexibility to the strip. The section of the constrictions 27 and 39 is substantially smaller than the cross-section of the two strips 21 and 23**.

The two constrictions 27 and 39 and the planished central portion impart such a high magnetic resistance to the strip 19 that substantially all of the magnetic flux originating from the excitation coil passes via the magnetically highly conductive strips 21 and 23.

The contact member 3 and the counter-contacts 5 and 7 are made of strip material having a thickness of 0.3 mm. This small material thickness offers the possibility of manufacturing the contact member and the counter-contacts by etching. Manufacture by means of etching techniques offers an advantage over the equally feasible punching techniques in that comparatively complex shapes — such as that of the contact member 3 — can be readily realized. Etching completely precludes the risk of burring. Moreover, during etching a large number of contact members can be simultaneously manufactured. The process conditions have then been exactly the same for all simultaneously manufactured contact members, so that a reproducibility is achieved which is higher than that which can be achieved by punching. The magnetizing of the magnet is preferably effected only after the assembly shown in FIG. 1 has been obtained. The risk of demagnetizing during the fitting of the cover plates 11 and 13 by the application of heat is then nil. Moreover, any metal particles present in the manufacturing room are prevented from adhering to the magnet during manufacture. The space within the frame 1 and the cover plates 11 and 13 is evacuated and filled with an inert gas in the manner commonly used for so-termed reed contacts.

Instead of being made of hard-magnetic material, the frame 1 can alternatively be made of other materials which are not or only hardly magnetically conductive, and which cannot be magnetized such as, for example, synthetic material.

In that case use must be made of separate permanent magnets which are fixed in the frame 1 in suitable recesses.

In the view of a further embodiment of a bistable switch according to the invention which is shown in FIG. 2, the cover plates, the coil former and the excitation coil have been omitted for the sake of simplicity. The switch shown comprises a frame 41 of hard-magnetic material on which a contact member 43 and two counter-contacts 45 and 47 are provided. The method of connection is identical to that already described for the switch shown in FIG. 1. The contact member 43 and the counter-contacts 45 and 47 are made of magnetically and electrically conductive strip material. The contact member 43 comprises three strip-shaped portions (strips) 49, 51 and 53 which are made from one piece of material. The longitudinal axes of the strips 49, 51 and 53 extend parallel to each other from a common base portion 55. The contact member 43 is mainly fork-shaped. The strips 51 and 53 are situated in the same plane, whilst the strip 49 extends in a plane perpendicular to the plane of the other two strips. Near its free end which is remote from the base portion 55, the strip 49 is provided with a contact flap 57 which is situated in the plane of the strips 51 and 53. The central portion of the strip 49 is thus twisted with respect to the base portion 55 and the flap 57.

The strips 51 and 53 have a comparatively high resistance against bending, while the strip 49 has a comparatively low resistance against bending.

The flap 57 extends beyond the free ends of the strips 51 and 53 and is situated between the counter-contacts 45 and 47 over a substantial part of its length. A contact opening 59 is present between the flap 57 and the counter contact 45. A second contact opening 61 is present between the flap 57 and the counter-contact 47. The air gaps 62*a* and 62*b* present between the free ends of the strips 51 and 53 and the flap 57 have been kept as narrow as possible. On its sides facing the counter contacts 45 and 47, the contact flap 57 is provided with molded-in spheres of contact material 63 and 65, for example, a gold-silver alloy.

The counter-contacts 45 and 47 are also provided with molded-in spheres of contact material 67 and 69, respectively.

In the frame 41 of hard-magnetic material two permanent magnets 71 and 73 are formed by a local magnetization, the said magnets being oppositely polarized in the direction shown in FIG. 2. The permanent magnets 71 and 73 and the counter-contacts 45 and 47 are magnetically connected to each other by way of a metal strip of a suitable magnetically conductive material which is provided on the lower side of the frame 41. The magnetic short-circuit strip 75 can be dispensed with in a multiple bistable switch, i.e. a stack of at least two of the switches shown in FIG. 2. In that case the counter-contacts of the upper or lower switch perform the function of the strip 75. The contact member 43 and the counter-contacts 45 and 47 can be manufactured by etching techniques as well as by punching techniques. After etching or punching, the central portion of the strip 49 is first planished and subsequently twisted with respect to the base portion 55 and the flap 57. The contact movement of the switch shown in FIG. 2 takes place in the plane of the strips 51 and 53 and the plane of the counter-contacts 45 and 47. The strip 49 has a comparatively high magnetic resistance, while the strips 51 and 53 have a comparatively low magnetic resistance.

The third embodiment of a bistable switch according to the invention which is shown in FIG. 3 (coil former and coil not shown) comprises a rectangular frame 77 of hard-magnetic material on which a contact member 79 and two counter-contacts 81 and 83 are provided. The contact member 79 and the counter-contacts 81 and 83 of strips of magnetically and electrically conductive material. In the strip-shaped contact member 79 a U-shaped slot consisting of three portions 85, 87, and 89 is formed. The slot portions 85 and 87, constituting the legs of the U, are parallel to the relevant outer edges of the contact member 79, i.e. at a distance therefrom which is smaller than the plate thickness of 0.3 mm.

Flexible arms 91 and 93 are thus produced, the movement thereof in the plane of the contact member 79 requiring a force which is smaller than the force which is required for a movement perpendicular to the plane of the contact member. Between the legs 85 and 87 of the U-shaped slot there is provided a comparatively rigid portion 95 which adjoins a base portion 97 and which is separated by the slot 89 from a flap 99 having a comparatively low magnetic resistance.

The flap 99 is supported by the flexible arms 91 and 93. The comparatively rigid portion 95 of the contact member 79 has a comparatively low magnetic resistance. In order to keep the magnetic resistance low, the slot 89 is kept as narrow as possible. The slots 85 and 87 may in principle be wider than the slot 89. The counter-contacts 81 and 83 are provided with molded-in spheres 101 and 103, respectively, of contact material, for example, a gold-silver alloy.

The flap 99 is provided with molded-in spheres 105 and 107 of contact material which are situated opposite the spheres 101 and 103. Two permanent magnets 109 and 111 are formed by local magnetization of the frame 77, the said magnets being oppositely polarized in the direction shown in the drawing. The permanent magnets 109 and 111 and the counter-contacts 81 and 83 are magnetically interconnected by a suitable magnetically conductive metal strip 113 which is provided on the lower side of the frame 77. As in the switch shown in FIG. 2, the magnetic flux path in a multiple construction of the switch of FIG. 3 can be closed by the counter-contacts of the upper or lower switch.

As regards the strength of the permanent magnets 9, 71, 79, 109 and 111 of the switches shown in the FIGS. 1, 2 and 3, respectively, it may in principle be stated that it is such that, after termination of the excitation generated for making contact, the contact flaps 29, 57 and 99 are maintained against the relevant counter-contact. Because the polarity of the excitation current is reversed upon each successive coil excitation, a change-over to the other counter-contact is made. The contact members and counter-contacts of the three switches shown are preferably manufactured by etching, but punching is also feasible.

The switches shown are particularly suitable for mounting on conductor boards in view of their limited height. The switches can also be readily stacked, so that a multiple construction is obtained. It is alternatively possible to provide a plurality of switches which are situated in the same plane and which are all operated by the same excitation coil within one and the same frame. It will be obvious that the excitation coil can be replaced by a manually or otherwise operable rotatable or slidable permanent magnet.

Even though electrically insulating hard-magnetic material is preferably used for the frames 1, 41 and 77, it is alternatively possible to use electrically conductive hard-magnetic materials. However, in that case the contact members and counter-contacts must be electrically insulated from the frame. This can be achieved, for example, by using an electrically insulating bonding agent for the connection to the frame.

As already stated with reference to the switch shown in FIG. 1, the frame of a switch need not necessarily be made of magnetizable material. It is alternatively possible to provide separate permanent magnets in provided recesses of an electrically conductive or non-conductive material.

Instead of planishing the central strip of the contact member, it is alternatively possible to provide only constrictions in the central portion of the switches shown in the FIGS. 1 and 2. These constrictions are not produced by planishing, but, for example, by etching or punching.

What is claimed is:

1. A bistable switch comprising a strip-shaped contact member of magnetically and electrically conductive material which is clamped near a first end, a second, freely movable end thereof being arranged between and brought alternatively into contact with one of two permanently arranged magnetically and electrically conductive counter-contacts by means of an externally generated magnetic flux, said counter contacts forming part of the magnetic flux path of a permanent hold magnet, which path also includes the free end of the contact member and the contact openings present between the said free end and the counter-contacts, characterized in that the contact member comprises a bending-resistant portion, having a comparatively low magnetic resistance, and a flexible portion having a comparatively high magnetic resistance.

2. A bistable switch is claimed in claim 1, characterized in that the contact member consists of a flexible central strip, having a comparatively high magnetic resistance, and two comparatively rigid lateral strips, having a comparatively low magnetic resistance, which are situated in the same plane on both sides of the central strip, the central strip and the two lateral strips constituting a fork-shaped contact member.

3. A bistable switch as claimed in claim 2, characterized in that the central strip is situated in the plane of the two lateral strips, the counter-contacts are formed by two strips which are parallel to each other and to the contact member and which are situated at some distance from each other, the said strips overlapping the free end of the central strip, and the switch comprises a permanent magnet arranged between said strips.

4. A bistable switch as claimed in claim 2, characterized in that the central strip of the contact member comprises a flexible, twisted portion, perpendicular to the plane of the lateral strips, and also comprises a plate-shaped contact portion which is integral with the first portion and lies in the plane of the lateral strips, the movement of the contact portion taking place in the plane of the lateral strips, the counter-contacts being formed by strips which overlap said contact portion and which are situated on both sides thereof in the plane of the lateral strips of the contact member.

5. A bistable switch as claimed in claim 2 characterized in that the central strip of the contact member comprises at least one constriction which adjoins a planished central portion.

6. A bistable switch as claimed in claim 1, characterized in that the contact member consists of a comparatively rigid central strip having a comparatively low magnetic resistance and two flexible lateral arms having a comparatively high magnetic resistance which are connected to each other by a plate-shaped contact portion, the contact portion being situated in and moving for making contact in the plane of the central strip, the counter-contacts being formed by two strips which overlap said contact portion and which are situated on both sides thereof in said plane of the central strip.

7. A bistable switch as claimed in claim 6, characterized in that said plate-shaped contact portion comprises contact material at the area of contact location on both sides, the portion of the two counter-contacts situated directly opposite the contact area of the plate-shaped contact portion also comprising contact material.

8. A bistable switch as claimed in claim 1, characterized in that said magnet is formed by a permanently magnetized portion of a closed, flat ring of hard-magnetic material on which the counter contacts are provided.

* * * * *